US007854600B2

(12) United States Patent
Ogawa

(10) Patent No.: US 7,854,600 B2
(45) Date of Patent: Dec. 21, 2010

(54) TUBE PUMP

(75) Inventor: Kenji Ogawa, Tokyo (JP)

(73) Assignee: Neuberg Company Limited, Tokyo (JP)

( * ) Notice: Subject to any disclaimer, the term of this patent is extended or adjusted under 35 U.S.C. 154(b) by 0 days.

(21) Appl. No.: 12/548,894

(22) Filed: Aug. 27, 2009

(65) Prior Publication Data

US 2010/0260633 A1 Oct. 14, 2010

(30) Foreign Application Priority Data

Apr. 14, 2009 (JP) ..... 2009-098189

(51) Int. Cl.
*F04B 43/12* (2006.01)

(52) U.S. Cl. ..... 417/474

(58) Field of Classification Search ..... 417/477.12, 417/474, 475; 604/153
See application file for complete search history.

(56) References Cited

U.S. PATENT DOCUMENTS

| | | | | |
|---|---|---|---|---|
| 1,922,196 | A * | 8/1933 | Butler | 417/475 |
| 2,285,974 | A | 6/1942 | Huber | |
| 2,629,333 | A * | 2/1953 | Olden | 417/475 |
| 2,961,965 | A | 11/1960 | Senning | |
| 3,417,707 | A | 12/1968 | Zimmer | |
| 3,902,490 | A | 9/1975 | Jacobsen | |
| 5,660,529 | A * | 8/1997 | Hill | 417/53 |
| 5,888,052 | A * | 3/1999 | Hill | 417/53 |
| 6,234,773 | B1 * | 5/2001 | Hill et al. | 417/474 |
| 7,217,108 | B2 * | 5/2007 | Herwig et al. | 417/475 |
| 2006/0173412 | A1 | 8/2006 | Susi | |
| 2008/0024040 | A1 * | 1/2008 | Ogawa | 310/328 |

FOREIGN PATENT DOCUMENTS

| | | |
|---|---|---|
| JP | 07-278625 | 10/1995 |
| JP | 09-256957 | 9/1997 |
| JP | 11-342199 | 12/1999 |
| JP | 2007-061389 | 3/2007 |
| JP | 2007-263018 | 10/2007 |
| JP | 2007-270689 | 10/2007 |

OTHER PUBLICATIONS

Harvard Apparatus, 22 Pleasant Street, South natick, Massachusetts 01760, U.S. A., Harvard '1203', Harvard Mechanical Peristaltic Pump, English translation of description included.

* cited by examiner

*Primary Examiner*—Devon C Kramer
*Assistant Examiner*—Bryan Lettman
(74) *Attorney, Agent, or Firm*—Rankin, Hill & Clark LLP

(57) ABSTRACT

A tube pump includes tubes, hooks, tube receivers, three or more fingers, and a drive mechanism. The tubes each include intermediate tubes, connectors, and end tubes. The tubes are attached by engaging the connectors with the hooks provided on upper and lower sides. The intermediate tubes are provided along the tube receivers. Tube press portions of the fingers are provided between the intermediate tubes. The fingers are driven by the drive mechanism so that the tube press portions are reciprocated between a position where one of the intermediate tubes is squeezed and a position where the other of the intermediate tubes is squeezed.

3 Claims, 13 Drawing Sheets

TUBE PUMP

The entire disclosure of Japanese Patent Application No. 2009-098189, filed Apr. 14, 2009, is expressly incorporated by reference herein.

BACKGROUND OF THE INVENTION

1. Field of the Invention

The present invention relates to a peristaltic tube pump for discharging liquid by opening and closing spaces in a tube, and a tube used for the tube pump. More particularly, the present invention relates to a tube pump for continuously discharging a predetermined amount of liquid and a tube used for the tube pump.

2. Description of Related Art

In a typical tube pump, a flexible tube is squeezed by a roller, fingers or the like to sequentially change a position where the interior of the tube is opened and closed, so that liquid is sucked into, sequentially delivered through and discharged from the tube. The merit of such a tube pump is that the tube pump does not need to be sealed and therefore liquid is not accumulated in the tube pump.

Thus, such a tube pump has been widely used for printers, infusion pumps, detergent supply pumps and the like. In other words, the tube pump has been widely used in mass production factories, laboratories and the like as a pump for discharging and delivering various types of liquid such as medical fluid, electrolyte, additive and adhesive.

Typically, the tube pump is a roller-type tube pump in which liquid is delivered by squeezing a tube using a roller.

However, since the tube is strongly squeezed in the roller-type tube pump, the tube is considerably sagged or displaced. Consequently, discharge accuracy is hardly improved.

Thus, a finger-type tube pump has been suggested in which a tube is less sagged or displaced as compared to the roller-type tube pump so as to improve accuracy (for example, see Document 1: JP-A-9-256957).

In the finger-type tube pump, fingers are reciprocated in sequence to squeeze the tube, thereby delivering liquid.

However, in a typical tube pump, irrespective of a roller-type or finger-type tube pump, liquid discharge is suspended when a squeezed part of the tube reaches an outlet of the tube because liquid is delivered by sequentially squeezing a tube using a roller or fingers. Thus, in the tube pump, liquid usually cannot be continuously discharged because of the structure of the tube pump.

To solve such a problem, there has been a roller-type tube pump including two tubes and two rollers used for squeezing the tubes respectively. In this roller-type tube pump, when liquid is not discharged from one of the tubes, liquid is discharged from the other tube by shifting the positions of the rollers from each other. Thus, liquid can be continuously discharged.

On the other hand, in a finger-type tube pump, a plurality of fingers are required to squeeze one tube. Thus, two series of fingers are required for two tubes, so that the number of parts is increased and the size of the pump is also increased.

Because tubes are less damaged in a finger-type tube pump as compared to a roller-type tube pump, two tubes may be used for increasing a discharge amount in the finger-type tube pump. However, since a plurality of fingers are required for each tube, the number of parts and the size of the pump are increased as described above.

Consequently, a compact tube pump for discharging liquid using two tubes while retaining the advantage of being able to improve discharge accuracy and prevent damage of the tubes in a finger-type tube pump has been desired.

SUMMARY OF THE INVENTION

An object of the invention is to provide a finger-type and compact tube pump for discharging liquid using two tubes, and a tube for the tube pump.

A tube pump according to an aspect of the invention includes: two tubes; first and second tube engagements; first and second tube receivers; three or more fingers; and a drive mechanism that drives the fingers, in which first and second tube engagements are spaced away from each other by a predetermined gap and the two tubes are detachably engaged in parallel between the tube engagements, the first and second tube receivers are provided along the two tubes so that the two tubes are interposed between the first and second tube receivers, the fingers each include a tube press portion interposed between the two tubes, the fingers being provided along the two tubes, and the drive mechanism drives each of the fingers to reciprocate between: a position where one of the two tubes is squeezed between the tube press portion and the first tube receiver; and a position where the other of the two tubes is squeezed between the tube press portion and the second tube receiver, and also drives each of the fingers so that the tubes are squeezed in sequence by the tube press portion from a position where the tubes are engaged with the first tube engagement toward a position where the tubes are engaged with the second tube engagement.

Since it is only required that two tubes are squeezed by the tube press portion, two separate tubes may be provided for supplying, delivering and discharging liquid. Alternatively, the ends of two tubes for delivering liquid may be jointed by a connector or the like to be connected to a single tube.

According to the aspect of the invention, the plurality of fingers each having the tube press portion are provided between the two tubes. Since the tube press portion of each finger is reciprocated between the positions where each of the tubes is squeezed by the drive mechanism, the two tubes are alternately squeezed. Accordingly, each finger can close a flow path of one of the tubes while opening a flow path of the other tube, and can open the flow path of the one of the tubes while closing the flow path of the other tube.

Thus, the two tubes are opened and closed at a phase of 180 degrees to deliver liquid through each of the tubes in sequence for continuously discharging.

When the two tubes are connected to one tube for discharging liquid, a discharge amount of the liquid jointed into the one tube from the two tubes can be kept approximately constant. Thus, pulsation of discharge liquid can be suppressed and liquid can be continuously discharged.

Further, since the two tubes can be squeezed by one series of fingers, increase in a number of parts can be prevented in a finger-type tube pump, thus providing a compact and inexpensive tube pump.

In the tube pump according to the aspect of the invention, it is preferable that the drive mechanism includes a motor and a drive shaft rotated by the motor, and the fingers each include a finger plate that is thin plate-shaped and a cam rotated together with the drive shaft. It is also preferable that the finger plate is an integrated component comprising a fixing portion fixed to a casing of the tube pump, a moving portion connected to the fixing portion via a first hinge, and a drive shaft portion connected to the moving portion via a second hinge. It is further preferable that the cam is an eccentric cam in which the drive shaft is fixed to a position eccentric to a center of the cam, and is rotatably supported in a hole provided on the drive shaft portion, the moving portion is provided with the tube press portion, the first hinge is provided such that the tube press portion of the moving portion is reciprocated between the two tubes relative to the fixing portion, and the second hinge is provided such that the drive shaft portion is movable relative to the moving portion in a direction orthogonal to a direction where the moving portion is moved by the first hinge on a plane orthogonal to the drive shaft.

According to the aspect of the invention, the finger plate is provided by a single component and thus can be manufactured at a low cost. For example, even when 10 to 20 finger plates are required, manufacturing cost for parts can be suppressed.

Also, since the fingers each include the finger plate that is an integrated component comprising the first and second hinges, the tube press portion does not jounce. Thus, discharge accuracy can be improved.

In a tube used for the tube pump according to another aspect of the invention, both ends of the tube are provided by one end tube element and an intermediate portion of the tube is provided by two intermediate tube elements branched from the one end tube element, and the two intermediate tube elements of the intermediate portion has a length to be strained in parallel to each other between the tube engagements when branched portions of the tube are engaged with the tube engagements of the tube pump.

According to the another aspect of the invention, the two intermediate tube elements of the intermediate portion are strained when the branched portions are engaged with the tube engagements. Accordingly, when the two intermediate tube elements are squeezed by the tube press portion, the intermediate tube elements are not displaced. Therefore, the intermediate tube elements can be reliably squeezed by the tube press portion, so that the flow paths of the intermediate tube elements can be opened and closed. Thus, discharge accuracy of the tube pump can be improved.

Also, the tube can be attached simply by engaging the branched portions where the end tube element is branched into the two intermediate tube elements with the tube engagements. Accordingly, the tube can be easily attached and detached. Thus, the tube can be easily exchanged to change a kind of discharge liquid or to clean the tube for maintenance.

In the tube used for the tube pump according to the another aspect of the invention, it is preferable that the one end tube element of the both ends and the two intermediate tube elements of the intermediate portion are separately provided, and the one end tube element of the both ends and the two intermediate tube elements of the intermediate portion are connected via Y-shaped connectors.

According to the another aspect of the invention, the tube with two branched intermediate sections can be provided simply by connecting the tube elements to the Y-shaped connectors. Thus, manufacturing cost of the tube can be reduced.

DETAILED DESCRIPTION OF PREFERRED EMBODIMENT(S)

An arrangement of a tube pump according to an exemplary embodiment of the invention will be described below.

Figure 1:
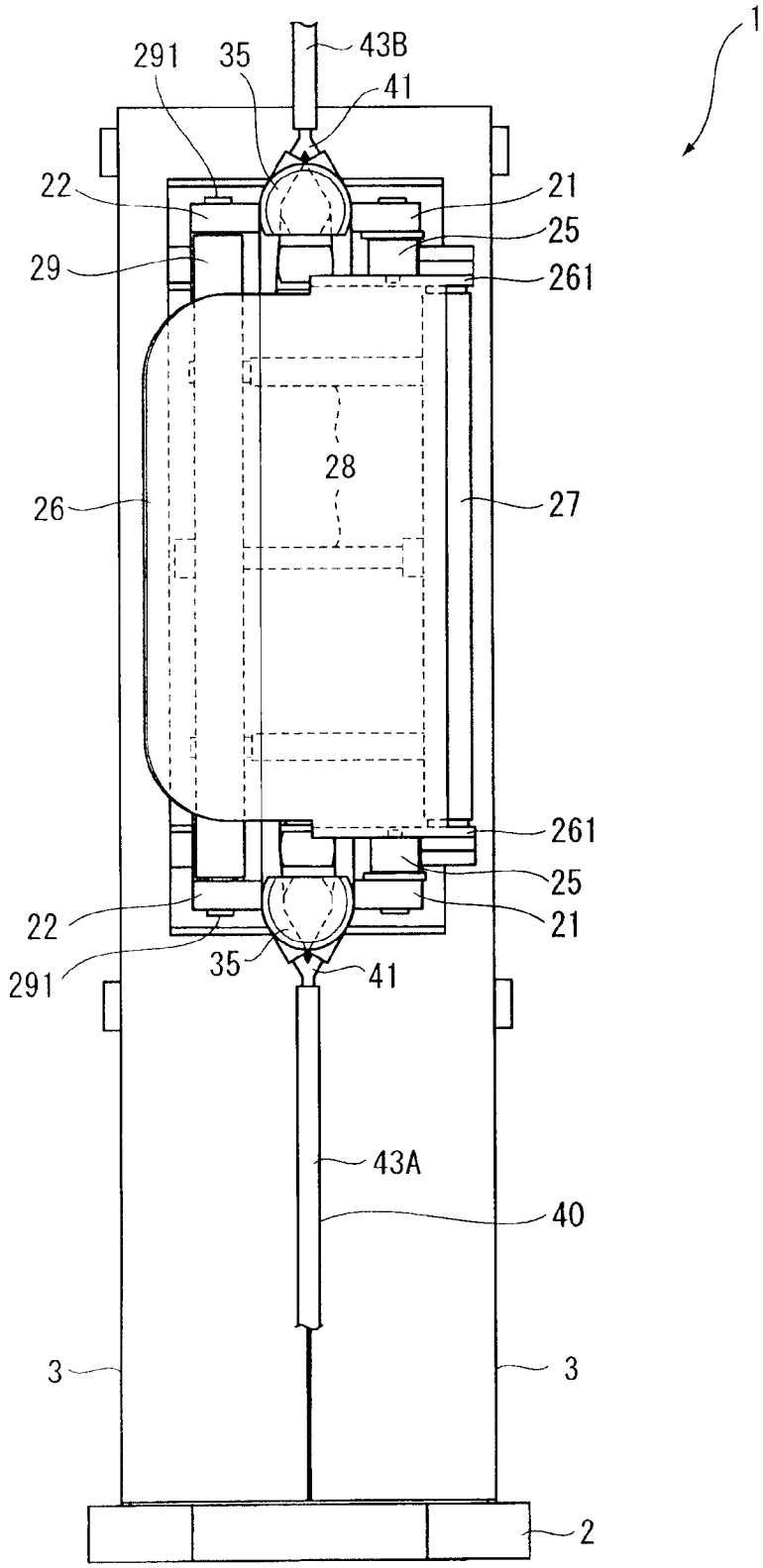
FIG. 1 is a front view of a tube pump according to an exemplary embodiment of the invention.
Figure 2:
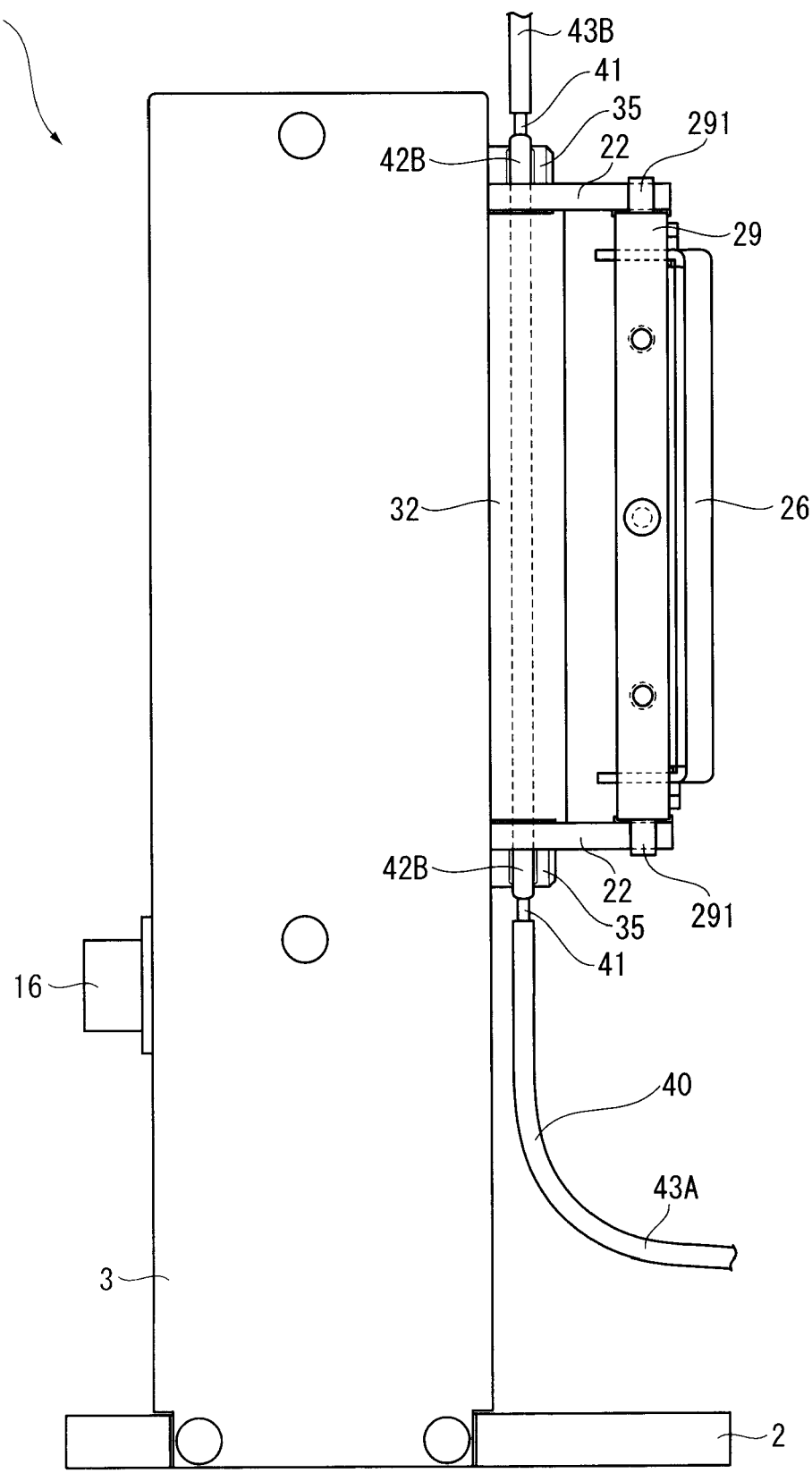
FIG. 2 is a side view of the tube pump.
Figure 3:
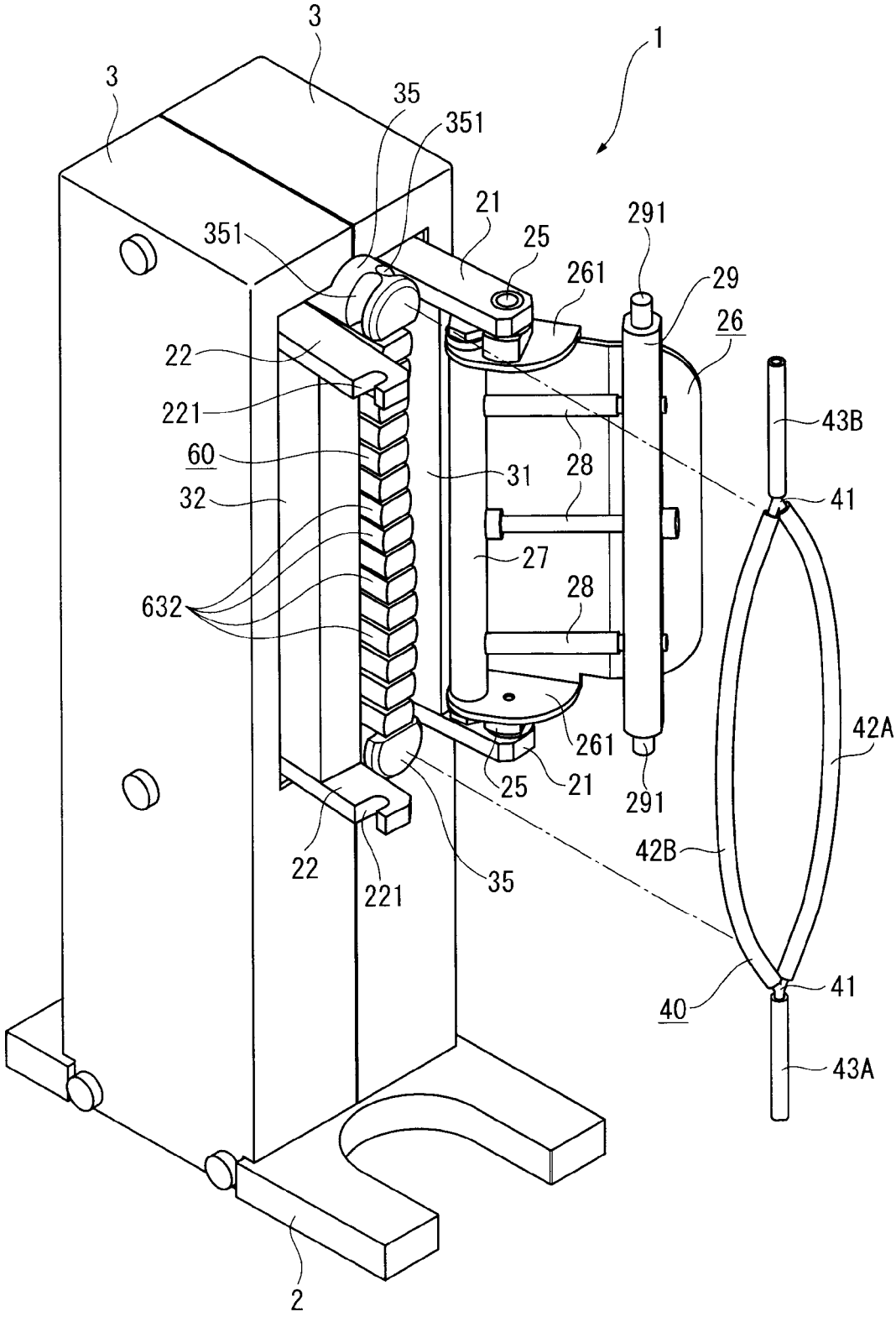
FIG. 3 is a cross-sectional view of the tube pump.

FIG. 1 is a front view of a finger-type tube pump 1 according to the exemplary embodiment. FIG. 2 is a side view of the tube pump 1 and FIG. 3 is a cross-sectional view of the tube pump 1.

The tube pump 1 includes a base 2 and a pair of covers 3 that are squared-C-shaped in horizontal cross section. A casing of the tube pump 1 is provided by the base 2 and covers 3.

Figure 4:
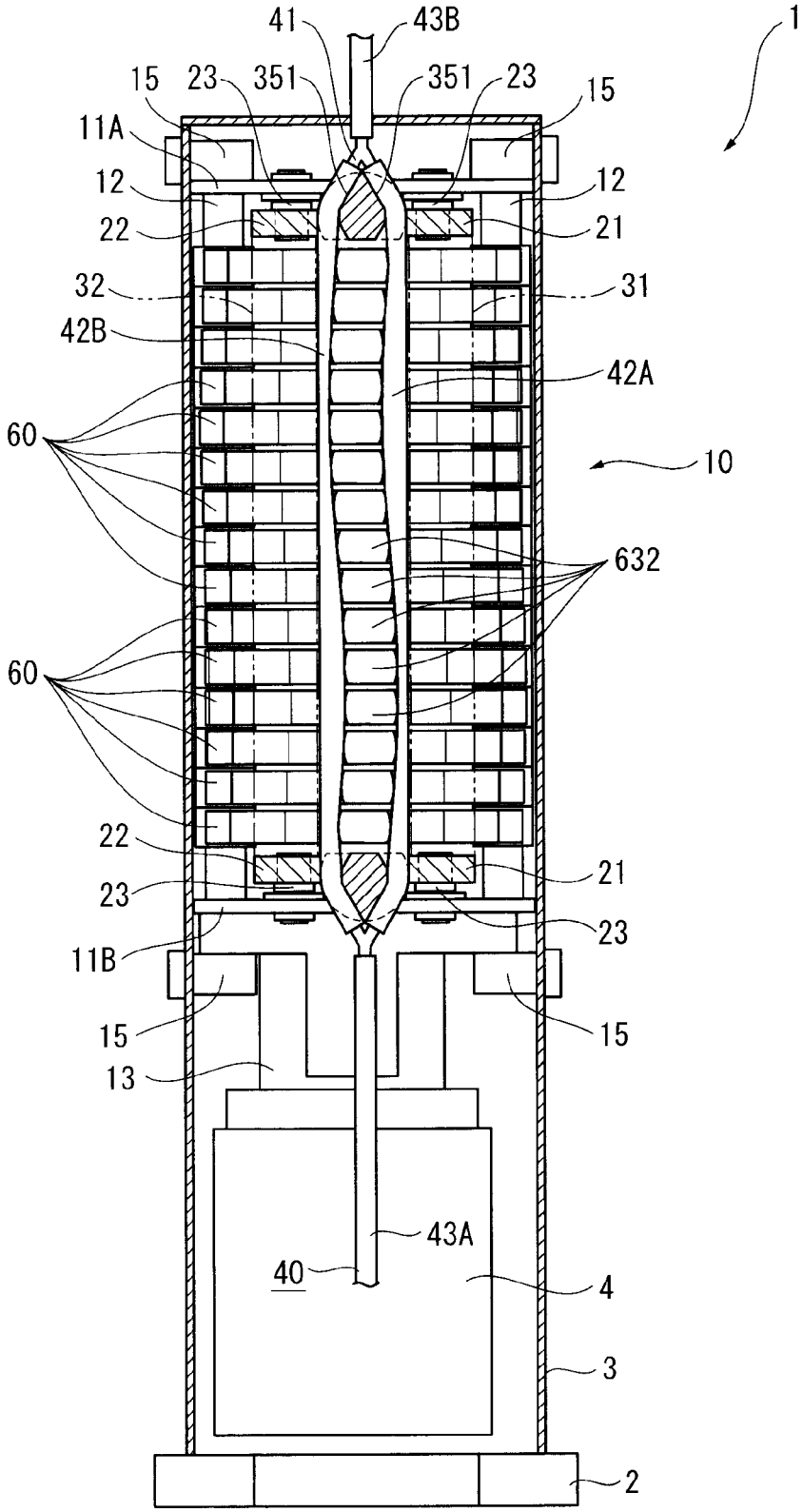
FIG. 4 is a front view of a pump assembly of the tube pump.
Figure 5:
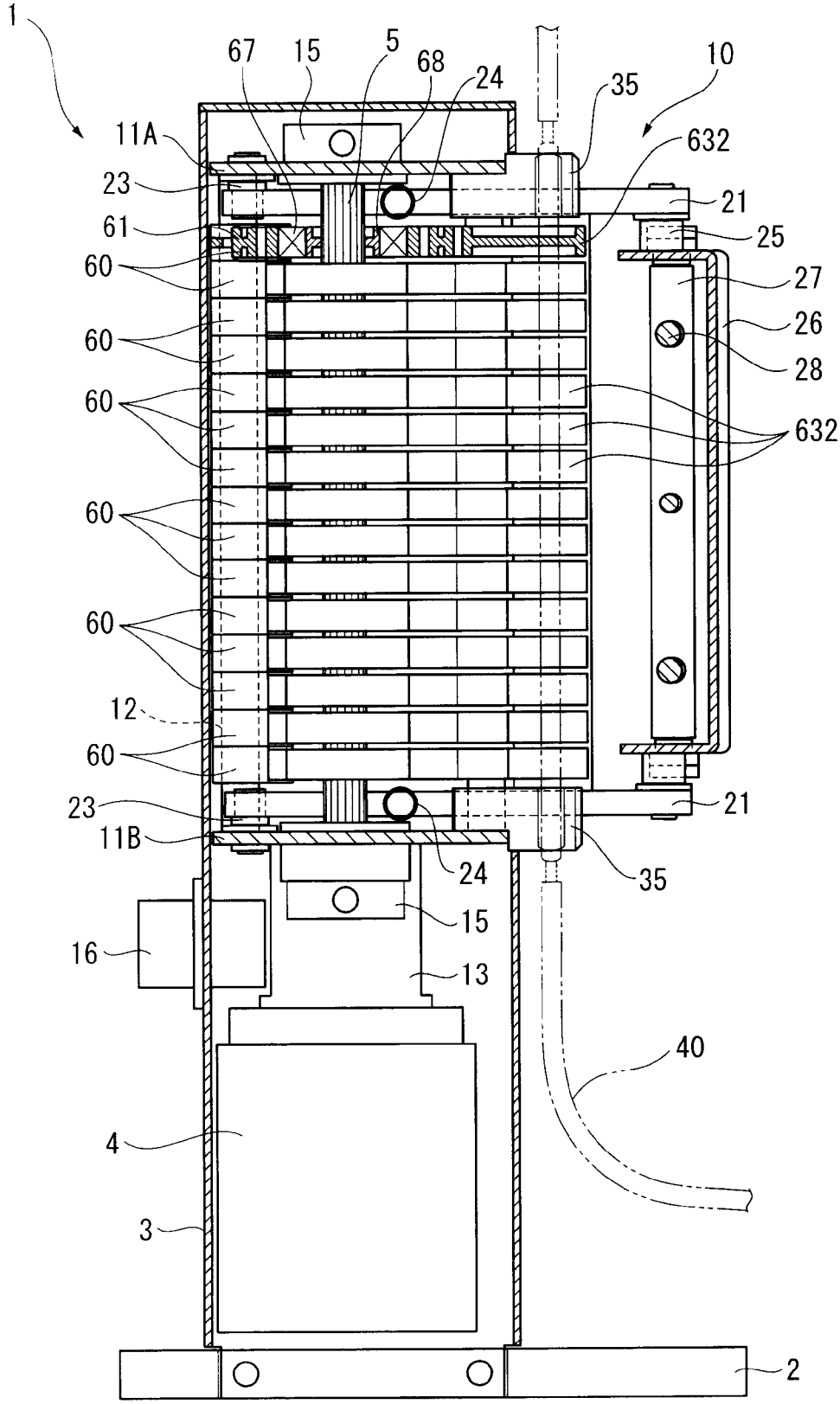
FIG. 5 is a side view of the pump assembly of the tube pump.

As shown in FIGS. 4 and 5, a motor 4 and a pump assembly 10 are provided in the casing.

The pump assembly 10 includes a pair of planarly-rectangular side plates 11A and 11B that are vertically spaced away from each other. Four support shafts 12 are provided between the side plates 11A and 11B on four corners thereof. The side plates 11A and 11B are screwed to ends of the support shafts 12.

A motor flange 13 is attached to the side plate 11B provided on the lower side. The motor 4 is attached to the motor flange 13. A control motor such as a stepper motor and servo motor is used as the motor 4.

An output shaft of the motor 4 is connected to a drive shaft 5 via a coupling disposed within the motor flange 13.

The drive shaft 5 is a spline shaft as described later, which is rotatable relative to the side plates 11A and 11B via a ball bearing.

The motor 4 and drive shaft 5 work as a drive mechanism of the invention.

Mounting blocks 15 are fixed to the motor flange 13 and the side plate 11A provided on the upper side, respectively.

A screw hole is formed on each mounting block 15. The mounting block 15 (i.e., the pump assembly 10) is fixed to the cover 3 by screwing a screw into the screw hole from outside through the cover 3.

A connector 16 that connects a signal line for controlling the motor 4 to a controller is also attached to the cover 3.

A shaft arm 21 and a receive arm 22 are respectively provided on a lower surface of the side plate 11A and an upper surface of the side plate 11B.

Figure 6:
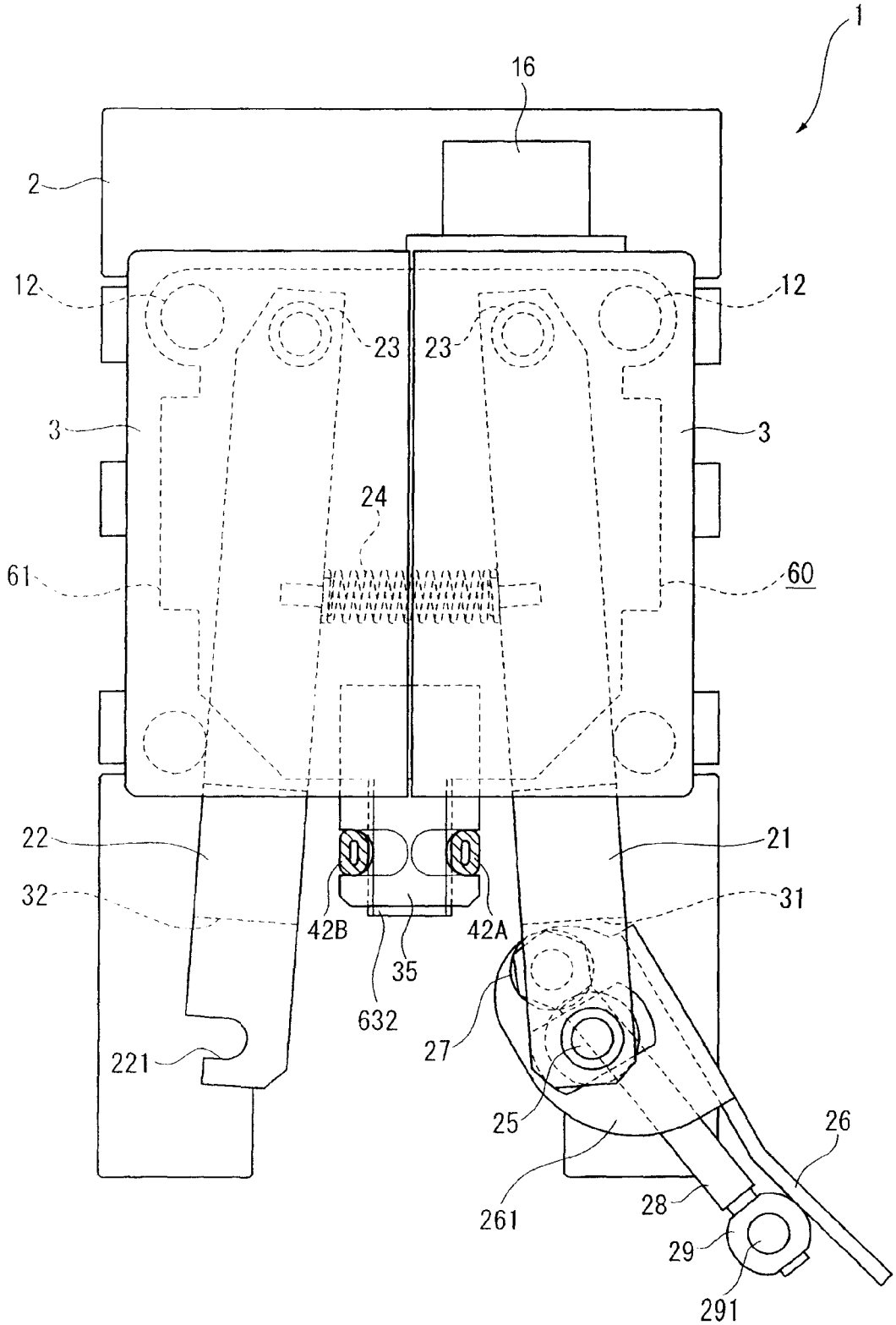
FIG. 6 is a top view of the tube pump.

As shown in FIG. 6, base ends of the shaft arm 21 and receive arm 22 are rotatable about arm shafts 23.

As shown in FIG. 3, when the tube pump 1 is viewed from the front side, a pair of shaft arms 21 are vertically separated by a predetermined interval at the right side and a pair of receive arms 22 are vertically separated by a predetermined interval at the left side.

As shown in FIG. 6, a coil spring 24 serving as a biasing unit is interposed between each pair of the shaft arm 21 and receive arm 22. Thus, the shaft arm 21 and receive arm 22 are moved to be in contact with the support shaft 12 by the coil spring 24 in a free state, so that distal ends of the shaft arm 21 and receive arm 22 are spaced away from each other.

As shown in FIG. 3, upper and lower flanges 261 provided on a toggle plate 26 are fixed to the distal ends of the shaft arms 21 via toggle plate shafts 25. The toggle plate 26 is rotatable relative to the shaft arms 21.

As shown in FIGS. 3 and 6, a toggle outer shaft 27 is rotatably provided between the flanges 261 of the toggle plate 26. A toggle receive shaft 29 is fixed to the toggle outer shaft 27 via three connecting rods 28. An engagement 291, which is a thin shaft, is projected from upper and lower ends of the toggle receive shaft 29.

An engaging groove 221 with which the engagement 291 is engaged is provided on the distal end of each of the receive arms 22.

Figure 7:
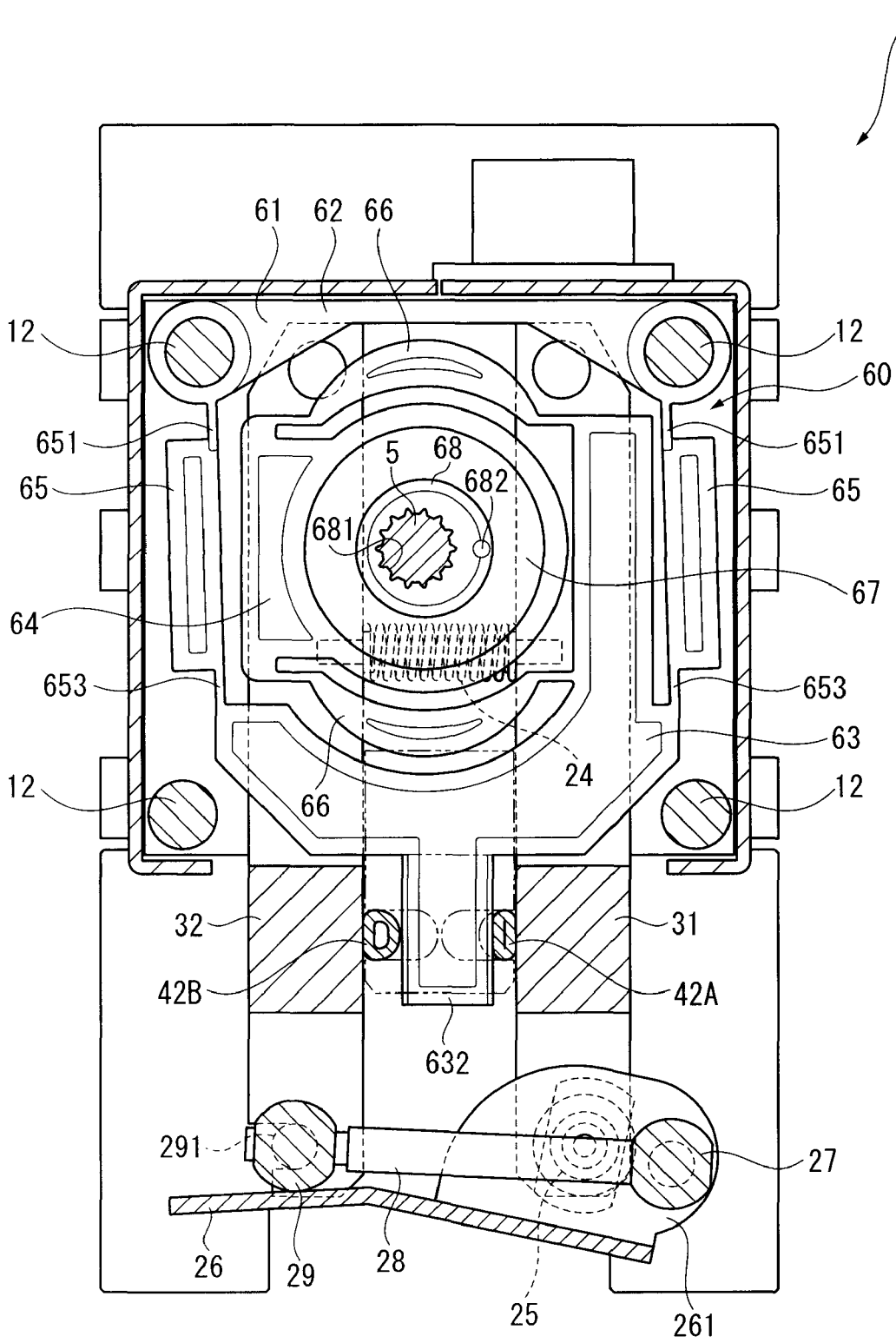
FIG. 7 is a top cross-sectional view of primary parts of the tube pump.

As is a typical toggle mechanism, when the toggle plate 26 is moved toward the receive arms 22 so that the engagement 291 of the toggle receive shaft 29 is engaged with the engaging groove 221 of each receive arm 22, the toggle outer shaft 27 is positioned further outside than the toggle plate shaft 25 so as to shorten a distance between the shaft arms 21 to which the toggle plate shafts 25 are attached and the receive arms 22 with which the toggle receive shaft 29 connected to the toggle outer shaft 27 via the connecting rods 28 is engaged. Thus, from a state where the distal ends of the shaft arms 21 and receive arms 22 are spaced away from each other as shown in FIG. 6, the shaft arms 21 and receive arms 22 are moved to be disposed in substantially parallel since the coil spring 24 is compressed as shown in FIG. 7.

A first tube receiver 31 is provided between the shaft arms 21. A second tube receiver 32 is provided between the receive arms 22.

The tube receivers 31 and 32 are vertically elongated rectangular parallelepiped blocks. Surfaces of the tube receivers 31 and 32, which face each other, are referred to as tube support surfaces.

As shown in FIGS. 1 to 5, the side plates 11A and 11B each are provided with a hook 35 serving as a tube engagement. The hook 35 mounted on the lower surface of the side plate 11A and the hook 35 mounted on the upper surface of the side plate 11B are identical members and are disposed upside down.

Two grooves 351 are formed on each of the hooks 35. As shown in FIG. 4, the grooves 351 obliquely extend in two different directions from the top. As shown in FIGS. 3 and 4, a tube 40 is fitted to the grooves 351.

Figure 8:
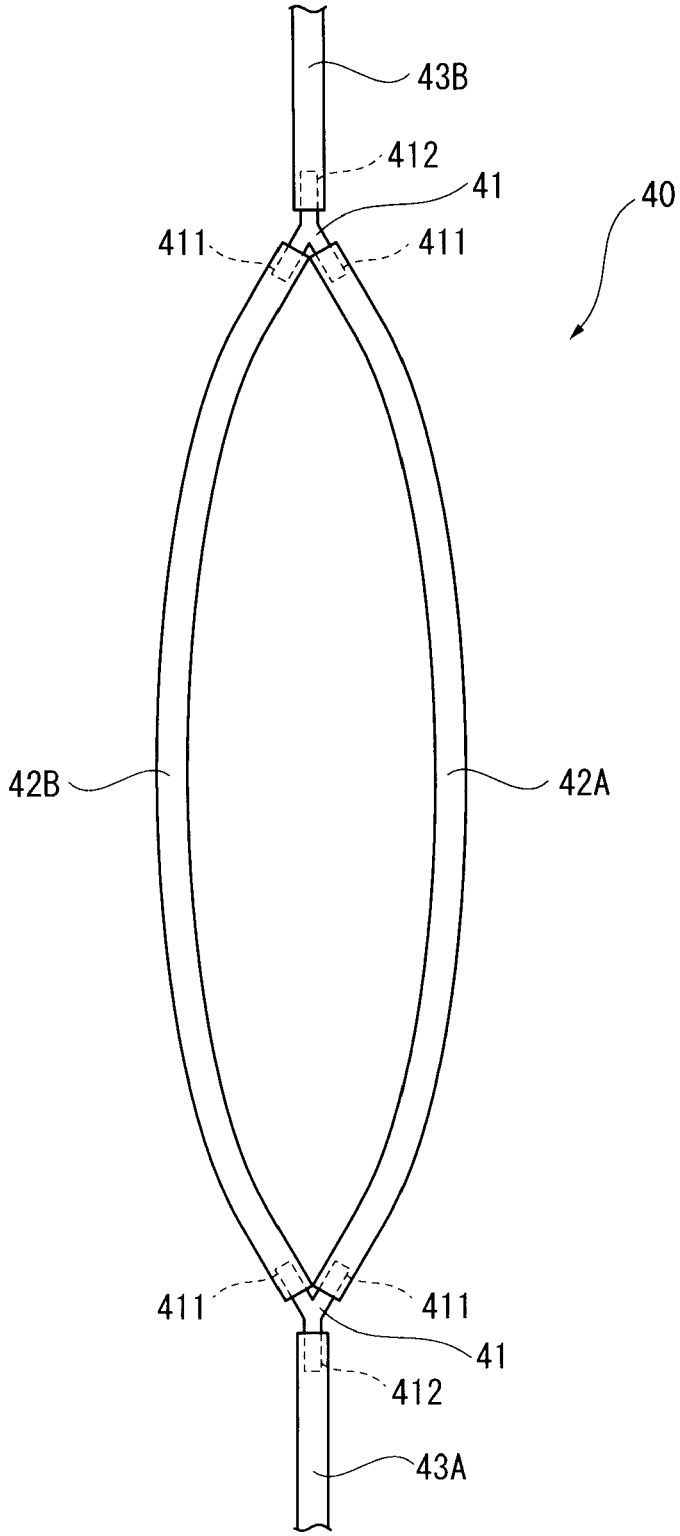
FIG. 8 is a front view of a tube of the tube pump.

As shown in FIG. 8, the tube 40 includes: two Y-shaped connectors 41; two intermediate tubes 42A and 42B provided between two branched connecting portions 411 of each of the connectors 41; and end tubes 43A and 43B of which ends are attached to connecting portions 412 of the connectors 41.

Accordingly, the intermediate tubes 42A and 42B provides two tube elements branched at an intermediate portion of the tube 40. The end tube 43A of the tube 40 provides a tube element on the side from which liquid is supplied, and the end tube 43B of the tube 40 provides a tube element on the side from which liquid is discharged.

A plurality of fingers 60 are provided between the side plates 11A and 11B. In this exemplary embodiment, fifteen fingers 60 are provided.

As shown in FIGS. 5 and 7, the fingers 60 each include a finger plate 61 made of plastic and thin-plate shaped, a ring-shaped ball bearing 67, and a circular-plate shaped cam 68.

Figure 9:
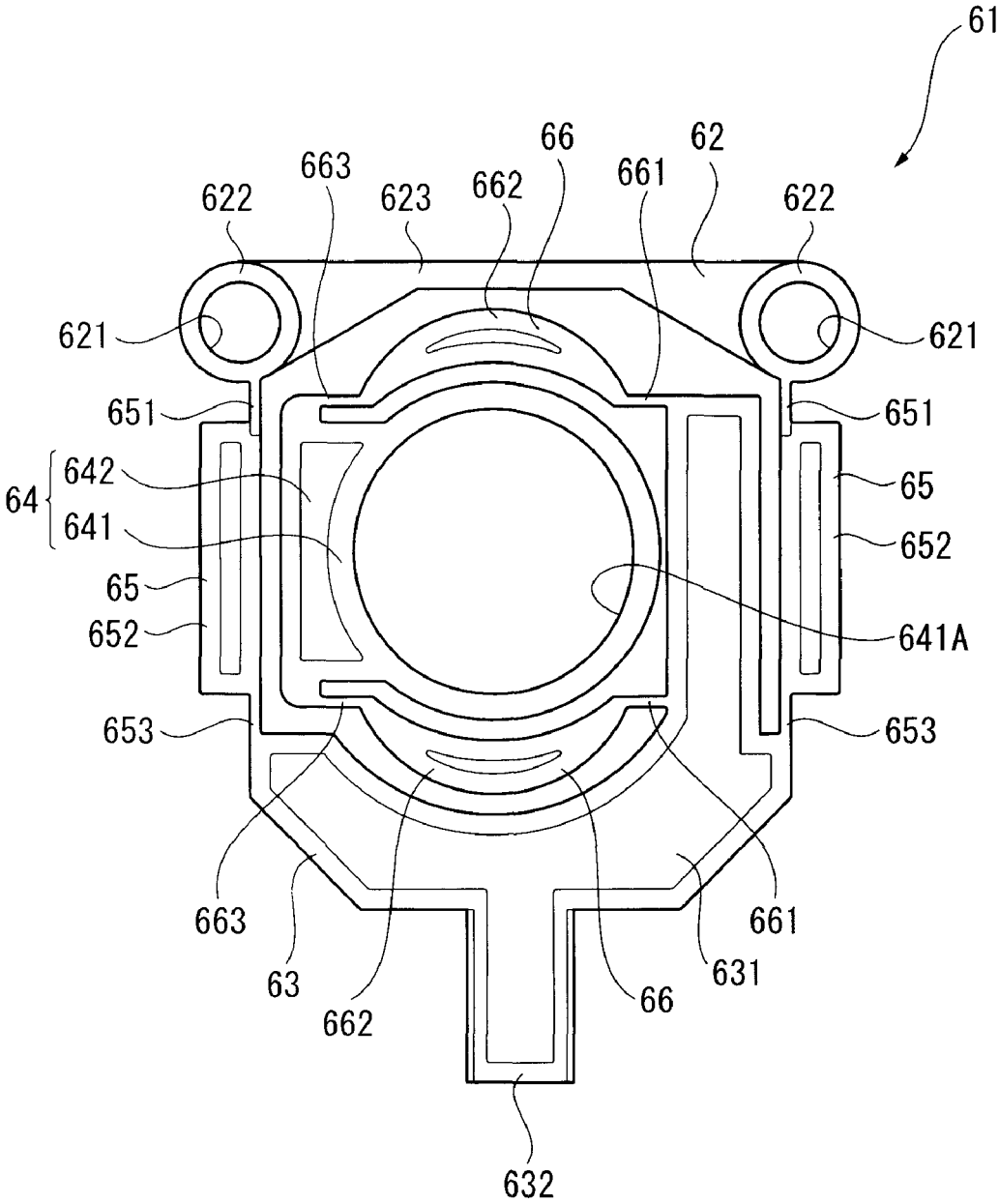
FIG. 9 is a plan view of a finger plate of the tube pump.

As shown in FIG. 9, the finger plate 61 is an integrated molding component including a fixing portion 62, a moving portion 63, a drive shaft portion 64, first hinges 65 and second hinges 66.

The fixing portion 62 includes a pair of fixed shafts 622 provided with openings 621 into which the support shafts 12 are inserted, and a connecting plate 623 for connecting the fixed shafts 622. The connecting plate 623 is thinner than the fixed shafts 622 for the purpose of weight saving.

The moving portion 63 includes a body 631 substantially J-shaped in horizontal cross section and a tube press portion 632 protruded from the body 631. The moving portion 63 has a ribbed and thick rim and a thin plate-shaped intermediate portion.

The fixed shafts 622 of the fixing portion 62 and the moving portion 63 are connected to each other by the pair of first hinges 65. The first hinges 65 each include: a first deformable part 651 connected to the fixed shafts 622; a reinforcing part 652 connected to the first deformable part 651; and a second deformable part 653 provided between the reinforcing part 652 and the moving portion 63. The reinforcing part 652 has a ribbed rim and a thin plate-shaped intermediate portion.

The deformable parts 651 and 653 are narrower than the reinforcing part 652. When the deformable parts 651 and 653 are bent (deformed), the moving portion 63 is laterally displaceable relative to the fixing portion 62 in FIG. 9. Thus, the tube press portion 632 is also laterally movable.

The drive shaft portion 64 includes: a ring 641 in which a through hole 641A for holding the ball bearing 67 is formed; and a connecting portion 642 connected to the ring 641. The connecting portion 642 has a ribbed rim and a thin plate-shaped intermediate portion.

The drive shaft portion 64 and the body 631 of the moving portion 63 are connected by the pair of second hinges 66.

The second hinges 66 each include: a first deformable part 661 connected to the body 631; a reinforcing part 662 that is crescentic in horizontal cross section and connected to the first deformable part 661; and a second deformable part 663 provided between the reinforcing part 662 and the connecting portion 642. The reinforcing part 662 has a ribbed rim and a thin plate-shaped intermediate portion.

The deformable parts 661 and 663 are narrower than the reinforcing part 662.

When the deformable parts 661 and 663 are bent (deformed), the drive shaft portion 64 is vertically displaceable relative to the moving portion 63 in FIG. 9.

A cam 68 is disposed in the through hole 641A of the drive shaft portion 64 via the ball bearing 67 as shown in FIG. 7.

The cam 68 is circular in horizontal cross section. The cam 68 has a ribbed and thick rim and a thin plate-shaped intermediate portion. A fitting hole 681 into which the drive shaft 5 is fitted is formed on this thin plate-shaped portion. The fitting hole 681 is deviated away from the center of the cam 68. The cam 68 is provided with a step 682 so as to easily identify a portion where a distance between the center of the fitting hole 681 and the outer circumference of the cam 68 is the longest.

Incidentally, the drive shaft 5 is a spline shaft on which fourteen keys (protrusions) are axially formed. Also, fourteen grooves into which the keys of the spline shaft are fitted are formed on the cam 68.

The fifteen fingers 60 are vertically piled while the support shafts 12 are inserted into the openings 621. The fitting orientations of the cams 68 of the fingers 60 to the drive shaft 5 are sequentially shifted by one key of the drive shaft 5 from the uppermost finger 60 toward the lowermost finger 60. Thus, phases of the respective cams 68 are shifted by 360/14 degrees in sequence from the uppermost finger 60 to the lowermost finger 60. The phase of the cam 68 of the uppermost finger 60 is the same as that of the lowermost finger 60.

Next, an operation of the exemplary embodiment will be described below with reference to FIGS. 7 and 10 to 12 explaining the operation.

When the drive shaft 5 is rotated by the motor 4, the cams 68 are rotated. The cams 68 are deviated away from the rotation center of the drive shaft 5. The fixing portions 62 of the fingers 60 are fixed by the support shafts 12 inserted into the openings 621. Thus, when the cams 68 are rotated, the tube press portions 632 of the respective finger plates 61 are laterally reciprocated as described later.

Since the cams 68 are fitted into the fourteen keys of the drive shaft 5 while sequentially shifting the orientations thereof by one key, the tube press portions 632 of the respective finger plates 61 are laterally reciprocated while shifting the phases.

When the step 682 of each cam 68 is disposed at the right side as shown in FIG. 7, i.e., when the position where the distance between the rotation center of the drive shaft 5 and the outer circumference of the cam 68 is the longest is at the right side, the drive shaft portion 64 is also moved toward the right side relative to the drive shaft 5.

Since the deformable parts 661 and 663 of each second hinge 66 are laterally extended in FIG. 7, the lateral displacement of the drive shaft portion 64 is directly transmitted to the moving portion 63 so as to move the moving portion 63 toward the right side relative to the drive shaft 5. At this time, the moving portion 63 is movable toward the fixing portion 62 by the deformation of the deformable parts 651 and 653 of each first hinge 65.

When the moving portion 63 is moved toward the right side, the tube press portion 632 is moved toward the tube receiver 31. Accordingly, the intermediate tube 42A is squeezed by the tube receiver 31 and the tube press portion 632. Thus, a space (flow path) in the intermediate tube 42A is closed.

On the other hand, since a space between the tube press portion 632 and the second tube receiver 32 is enlarged, the intermediate tube 42B is not squeezed and a space (flow path) thereof is opened.

Figure 10:
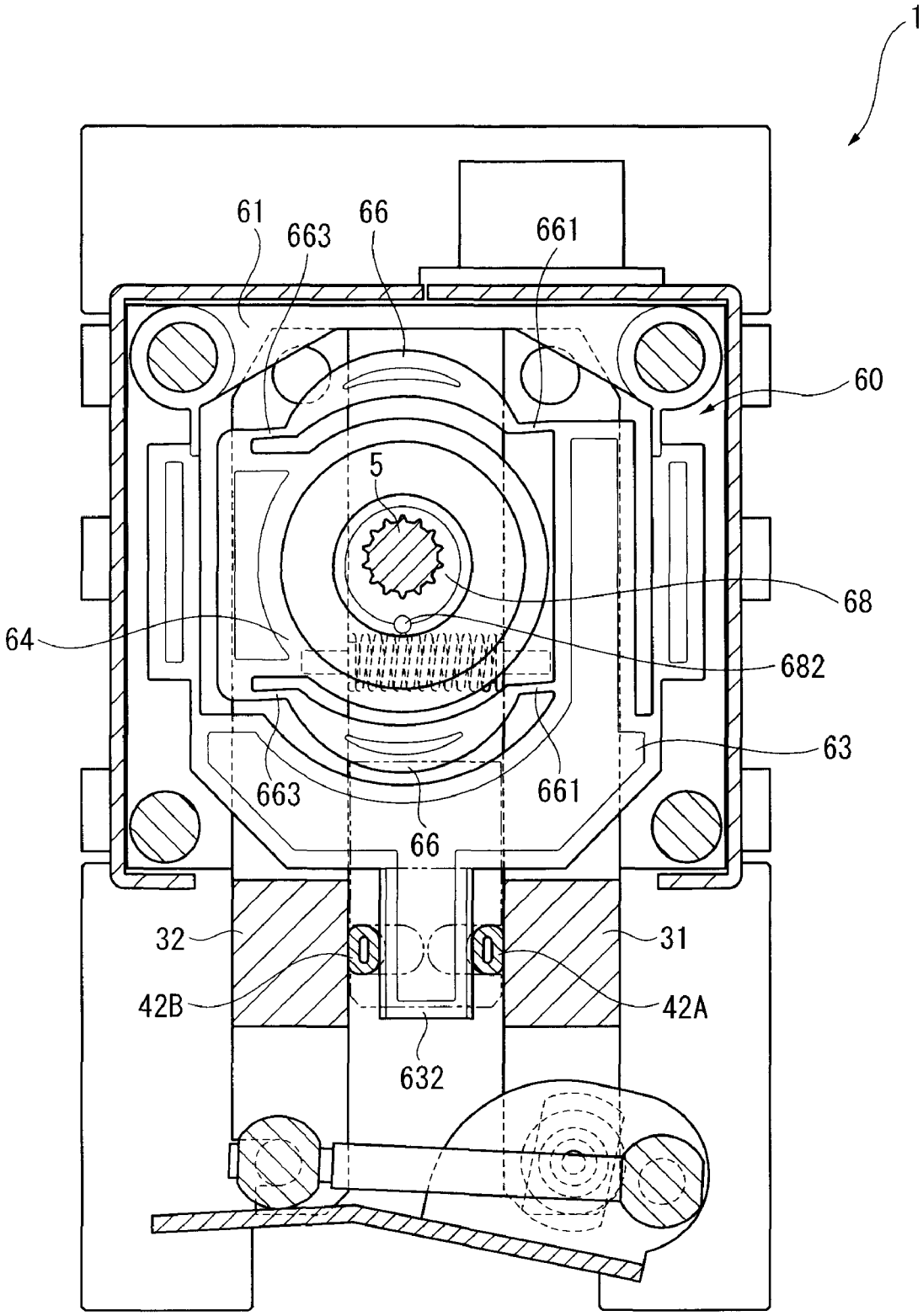
FIG. 10 is a top cross-sectional view of the primary parts of the tube pump.

When the drive shaft 5 is rotated clockwise by 90 degrees from the state as shown in FIG. 7 to be positioned in the state as shown in FIG. 10, the step 682 of the cam 68 is moved to the lower side in FIG. 10, i.e., the front side of the tube pump 1.

At this time, the drive shaft portion 64 is moved toward the lower side relative to the drive shaft 5 in the figure. This movement of the drive shaft portion 64 is absorbed by the deformation of the deformable parts 661 and 663 of each second hinge 66. Since the cam 68 is not laterally moved relative to the drive shaft 5, the tube press portion 632 is gradually moved toward the center of the space between the tube receivers 31 and 32 while the cam 68 is rotated from the position shown in FIG. 7 to the position shown in FIG. 10.

Thus, the flow path of the intermediate tube 42A, which is squeezed by the tube press portion 632, is gradually opened. Conversely, the intermediate tube 42B is gradually squeezed by the tube press portion 632. The cross-sectional area of the flow path of the intermediate tube 42B is gradually decreased, but the flow path is not completely closed.

Figure 11:
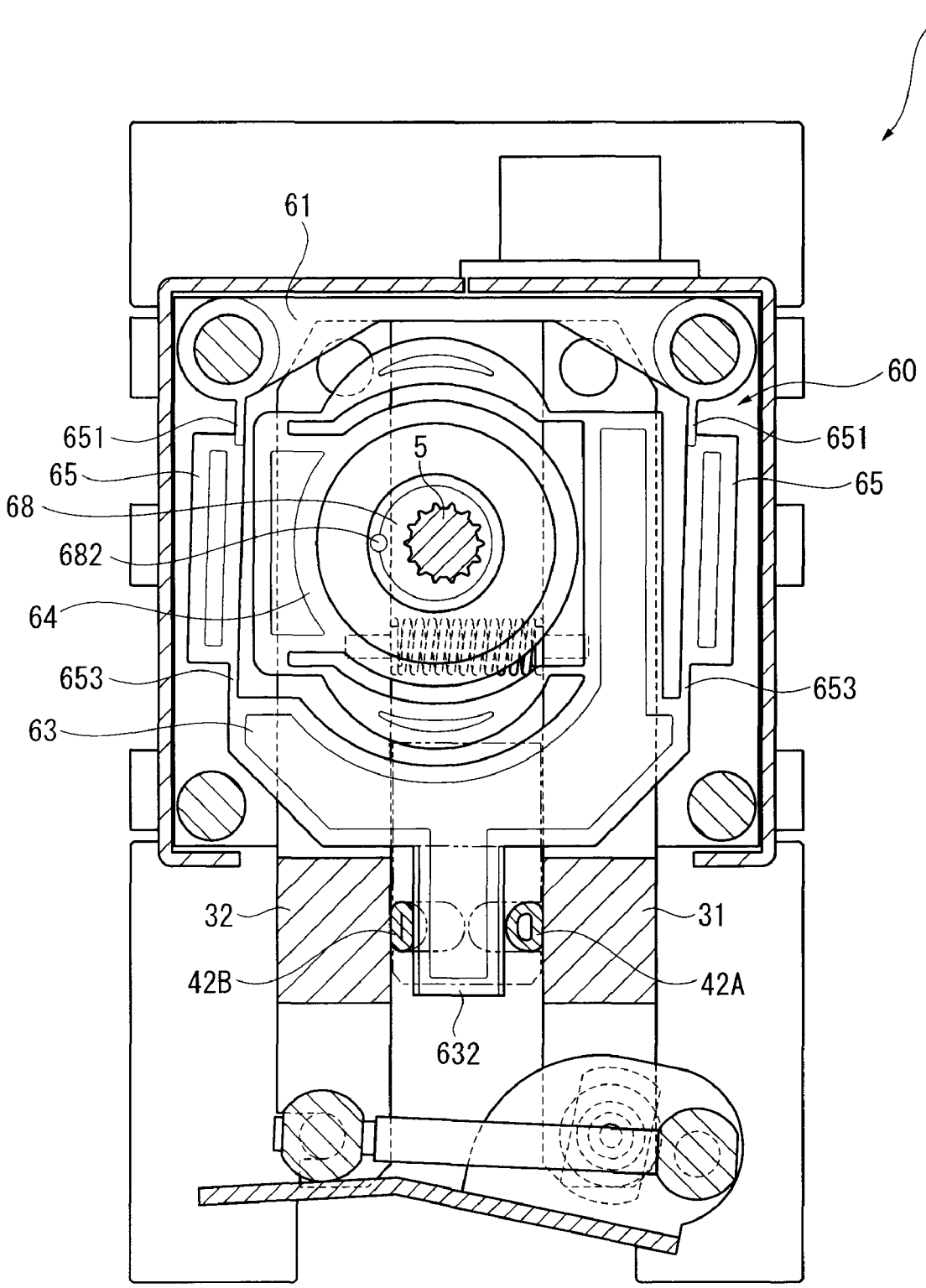
FIG. 11 is a top cross-sectional view of the primary parts of the tube pump.

When the drive shaft 5 is rotated clockwise by 90 degrees from the state as shown in FIG. 10 to be positioned in the state as shown in FIG. 11, the step 682 of the cam 68 is moved to the left side in FIG. 11.

At this time, the drive shaft portion 64 is moved to the left side relative to the drive shaft 5 in the figure The moving portion 63 is also moved to the left side since the deformable parts 651 and 653 of each first hinge 65 are deformed.

The tube press portion 632 is gradually moved from the center of the space between the tube receivers 31 and 32 toward the second tube receiver 32 while the cam 68 is rotated from the position shown in FIG. 10 to the position shown in FIG. 11.

When the moving portion 63 is moved to the left side, the tube press portion 632 is moved toward the tube receiver 32. Accordingly, the intermediate tube 42B is squeezed by the tube receiver 32 and the tube press portion 632. Thus, the space (flow path) in the intermediate tube 42B is closed.

Conversely, the space between the tube press portion 632 and the tube receiver 31 is enlarged, so that the flow path of the intermediate tube 42A is further opened.

Figure 12:
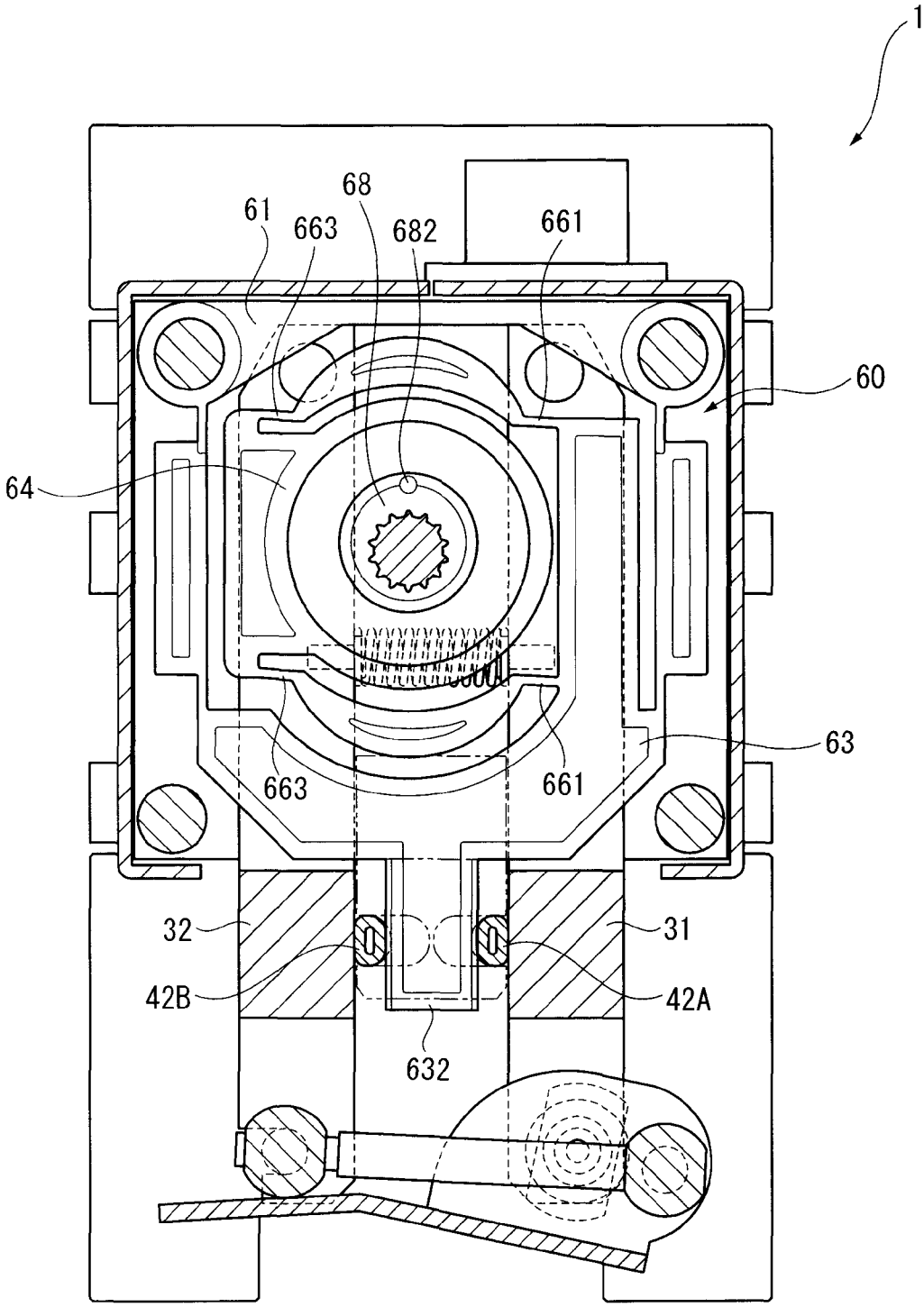
FIG. 12 is a top cross-sectional view of the primary parts of the tube pump.

When the drive shaft 5 is rotated clockwise by 90 degrees from the state as shown in FIG. 11 to be positioned in the state as shown in FIG. 12, the step 682 of the cam 68 is moved to the upper side in FIG. 12, i.e., the rear side of the tube pump 1.

At this time, the drive shaft portion 64 is moved to the upper side relative to the drive shaft 5 in the figure. This movement of the drive shaft portion 64 is absorbed by the deformation of the deformable parts 661 and 663 of each second hinge 66. Since the cam 68 is not laterally moved relative to the drive shaft 5, the tube press portion 632 is gradually moved toward the center of the space between the tube receivers 31 and 32 while the cam 68 is rotated from the position shown in FIG. 11 to the position shown in FIG. 12.

Thus, the flow path of the intermediate tube 42B, which is squeezed by the tube press portion 632, is gradually opened. The cross-sectional area of the flow path of the intermediate tube 42A is gradually decreased since the intermediate tube 42A is gradually squeezed by the tube press portion 632, but the flow path of the intermediate tube 42A is not completely closed.

When the drive shaft 5 is rotated clockwise by 90 degrees from the state as shown in FIG. 12, the drive shaft 5 is returned to its original position as shown in FIG. 7. Thus, when the drive shaft 5 and the cam 68 are rotated by 360 degrees, the tube press portion 632 of each finger 60 is reciprocated once between the tube receivers 31 and 32. By repeating the above-described movement, the intermediate tubes 42A and 42B are alternately squeezed.

As shown in FIG. 4, since the phases of the cams 68 of the fifteen fingers 60 vertically piled are shifted in increments, the tube press portions 632 are laterally misaligned in increments. Thus, the tube press portions 632 are vertically lined to show a substantially sine curve.

In order to discharge liquid using the tube pump 1 having the above-described arrangement, the toggle plate 26 is initially opened so that the distal ends of the shaft arms 21 and receive arms 22 are spaced away from each other. Then, the tube 40 is hanged on the hooks 35. At this time, the intermediate tubes 42A and 42B of the tube 40 are slightly strained to be vertically and linearly disposed on left and right sides of the tube press portions 632. Since the intermediate tubes 42A and 42B are strained, the intermediate tubes 42A and 42B are not moved laterally or vertically.

Next, the toggle plate 26 is moved toward the receive arms 22 to be closed. Then, the shaft arms 21 and receive arms 22, of which the distal ends are spaced, are moved to be in parallel. The tube receivers 31 and 32 are brought into contact with the intermediate tubes 42A and 42B.

The end tube 43A of the tube 40 is connected to an object from which liquid is supplied (for instance, a container for storing liquid), and the end tube 43B is connected to an object toward which liquid is discharged (for instance, a discharge nozzle).

Preparatory work of the tube pump 1 is conducted as described above.

Next, the motor 4 is driven by an external controller. When the drive shaft 5 is rotated by the drive of the motor 4, the tube press portion 632 of each finger 60 is laterally moved to open and close the flow paths of the intermediate tubes 42A and 42B. Accordingly, liquid is sucked from the end tube 43A and is delivered toward the end tube 43B.

Specifically, the intermediate tubes 42A and 42B are alternately closed by the tube press portion 632 of the lowermost finger 60, and then are alternately closed by the tube press portion 632 of the subsequent finger 60 at the next higher stage in sequence. Thus, a position where either one of the flow paths in the intermediate tubes 42A and 42B is closed is moved upward in sequence.

When the closed flow path is opened, negative pressure is generated, so that liquid is sucked from the end tube 43A. The sucked liquid is separated from the end tube 43A by the connector 41 and then delivered into the intermediate tubes 42A and 42B.

Since the flow paths in the intermediate tubes 42A and 42B are opened and closed by the tube press portions 632 in sequence, liquid is gradually delivered upwardly in the intermediate tubes 42A and 42B. Then, the liquid is delivered into the end tube 43B through the connector 41 to be discharged.

At this time, the phases of the timings for opening and closing the intermediate tubes 42A and 42B are different by 180 degrees. Thus, a discharge amount of liquid joined together in the end tube 43B after being separated into the intermediate tubes 42A and 42B from the end tube 43A can be always kept constant.

When the tube 40 is replaced such as when liquid is completely discharged, the motor 4 is stopped and the toggle plate 26 is opened to remove the tube 40 engaged with the hooks 35. Then, the tube 40 being cleaned and dried or alternatively prepared is newly engaged with the hooks 35 and the toggle plate 26 is closed, so that liquid can be discharged again.

According to the exemplary embodiment, the following advantages can be attained.

In the finger-type tube pump 1 using the plurality of fingers 60, the two intermediate tubes 42A and 42B can be squeezed by moving one series of fingers 60. Accordingly, the number of the fingers 60 can be reduced by half as compared to a case when one series of fingers are provided for each tube.

Thus, even in the finger-type tube pump 1 using the two tubes 42A and 42B, increase in the number of parts can be suppressed. Consequently, the tube pump 1 can be downsized and manufactured at low cost.

The tube 40 is branched into the intermediate tubes 42A and 42B through the connector 41 from the end tube 43A for supplying liquid, and then jointed together in the end tube 43B through the connector 41. Further, the tube press portions 632 of the fingers 60 open and close the intermediate tubes 42A and 42B at a phase of 180 degrees. Thus, liquid can be delivered through two paths with different phases by 180 degrees and pulsation of the discharge liquid can be suppressed.

Also, when the tube 40 is detached from the tube pump 1 such as when the tube 40 is exchanged to change a kind of discharge liquid or when the tube 40 is cleaned for maintenance, the toggle plate 26 is opened so that the distal ends of the shaft arms 21 and receive arms 22 are spaced. The tube 40 can be exchanged by hooking the connectors 41 with the grooves 351 of the hooks 35. Thus, the tube 40 can be easily exchanged. Even when the tube 40 needs to be exchanged more than once a day, the tube 40 can be easily and quickly exchanged.

In addition, since the shaft arms 21 and receive arms 22 are moved by the toggle mechanism using the toggle plate 26, the tube 40 can be also easily and quickly exchanged.

The lengths of the intermediate tubes 42A and 42B of the tube 40 are set such that the intermediate tubes 42A and 42B are strained when being engaged with the hooks 35. Accordingly, the intermediate tubes 42A and 42B are not moved when the intermediate tubes 42A and 42B are squeezed by the tube press portions 632, so that the tube press portions 632 can reliably squeeze the intermediate tubes 42A and 42B to open and close the flow paths. Thus, discharge accuracy of the tube pump 1 can be improved.

Further, since the intermediate tubes 42A and 42B of the tube 40 are vertically and linearly provided, air within the tube, which causes a discharge amount error, can be easily discharged. Thus, discharge accuracy can be further improved. Even when the tube 40 is exchanged, variation of discharge amount can be suppressed and therefore liquid can be stably discharged.

Further, since the fingers 60 each include the finger plate 61 integrated with the fixing portion 62, the moving portion 63, the drive shaft portion 64, the first hinges 65 and the second hinges 66, the tube press portion 632 of the finger plate 61 can be reciprocated by the rotation of the drive shaft 5 and the cam 68. In contrast, fingers of a typical tube pump are axially advanced and retracted by cams. Each finger is advanced to squeeze a tube and is retracted to open the tube. At this time, to move the finger in conjunction with the cam, the finger is biased toward the cam by a spring to be always in contact with the cam. Accordingly, it is difficult to squeeze the tube when the finger is retracted because the spring force needs to be adjusted. Thus, when typical fingers are biased toward the cams, it is difficult to squeeze two tubes with one series of fingers. However, when the fingers 60 of the exemplary embodiment are used, the tube press portions 632 can be laterally reciprocated using the hinge mechanism. Thus, the two tubes can be alternately squeezed when the tubes are provided on both sides of the tube press portions 632.

Also, since the fingers 60 each include the finger plate 61 integrated with the first hinges 65 and second hinges 66, the tube press portions 632 do not jounce. Thus, discharge accuracy can be further improved.

Furthermore, since the tube press portions 632 are laterally moved relative to the fixing portions 62 by a short stroke (movement amount), the tube press portions 632 can be moved in parallel. Accordingly, the tube press portions 632 squeeze the intermediate tubes 42A and 42B in parallel to the tube receivers 31 and 32. Thus, the tube press portions 632 can equally squeeze the intermediate tubes 42A and 42B to reliably close the flow paths.

In addition, since the finger plates 61 are not rubbed by other components, the finger plates 61 can be made of one component and therefore can be manufactured at low cost. Especially, since many finger plates 61 are used, cost for parts can be considerably reduced.

Since a discharge amount when the drive shaft 5 is rotated by 360 degrees is constant, the discharge amount per hour can be easily set by adjusting rotation speed of the drive shaft 5. Thus, the tube pump 1 can be easily used.

It should be noted that the invention is not limited to the above-described exemplary embodiment, but includes modifications and improvements as long as an object of the invention can be achieved.

For example, it is not necessary that the tube 40 includes the connectors 41. For example, the end tubes 43A and 43B may be connected to the intermediate tubes 42A and 42B by an adhesive. In short, it is only required that the tube is branched into two parts on a portion to be attached to the tube pump 1.

Figure 13:
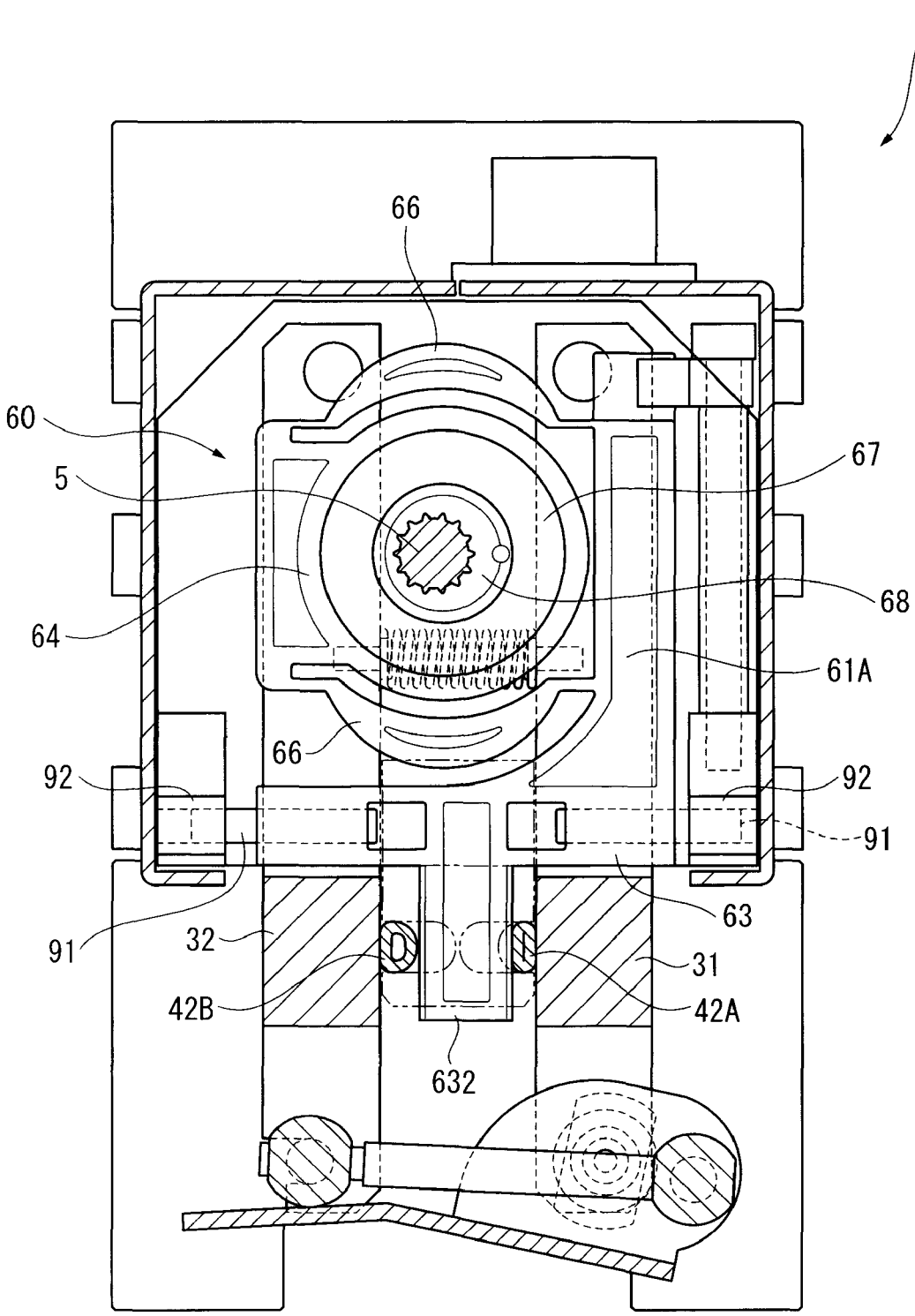
FIG. 13 is a top cross sectional view of primary parts of a tube pump using a finger plate according to a modification of the invention.

The finger plate 61 is not limited to the above-described exemplary embodiment. For example, as shown in FIG. 13, laterally projecting guide pins 91 may be provided on the moving portion 63 and guides 92 for guiding the guide pins 91 may be provided on the casing. Then, a finger plate 61A may be used for only laterally moving the moving portion 63, i.e., the tube press portion 632.

The finger plate 61A is supported by the guide pins 91 and guides 92 on the casing. When the drive shaft portion 64 is laterally moved by the rotation of the drive shaft 5 and the cams 68, the moving portion 63 and tube press portion 632 are also laterally moved. Thus, the finger plate 61A does not include the fixing portion 62 and first hinges 65, which are provided in the finger plate 61 of the exemplary embodiment.

Incidentally, similarly to the finger plate 61, the movement of the finger plate 61A is absorbed by deformation of the second hinges 66 when the drive shaft portion 64 is moved back and forth.

The finger plate 61A is operated in the same manner and provides the same advantages as the exemplary embodiment.

However, since the finger plate 61A includes other components such as the guide pins 91 and guides 92, the number of parts is increased. In this regard, cost can be reduced when the finger plate 61 of the exemplary embodiment including fewer components is used.

Further, although the ball bearing 67 is interposed between the cam 68 and the drive shaft portion 64 in the exemplary embodiment, the cam 68 may be provided directly on the through hole 641A of the drive shaft portion 64 without providing the ball bearing 67.

Alternatively, an outerlace may be provided by a groove on an inner circumference of the through hole 641A and an innerlace may be provided by a groove on an outer circumference of the cam 68. Then, a ball (a holder as needed) may be disposed between the outerlace and innerlace to directly provide a ball bearing.

Although the fifteen fingers 60 are provided in the exemplary embodiment, the number of the fingers may be less than fifteen or may be more than fifteen. However, since variation of discharge amount becomes large when a number of the fingers 60 is small, it may become difficult to keep the constant discharge amount.

Conversely, when the number of the fingers 60 is increased, the tube pump 1 is enlarged and manufacturing cost is also increased. Accordingly, the number of the fingers 60 may be set in view of the above.

Although the intermediate tubes 42A and 42B are vertically disposed in the exemplary embodiment, the intermediate tubes 42A and 42B may be horizontally disposed.

Further, although the shaft arms 21 and receive arms 22 that are attached to the tube receivers 31 and 32 are moved to easily detach the tube 40 by the toggle mechanism such as the coil spring 24 and the toggle plate 26 in the exemplary embodiment, the moving mechanism is not limited thereto.

Although the two intermediate tubes 42A and 42B are disposed between the tube receivers 31 and 32 in the exemplary embodiment, the tube pump of the invention can be used with only one tube. In other words, when one tube is provided between one of the tube receivers 31 and 32 and the tube press portions 632, liquid can be delivered through and discharged from the tube.

At this time, the tube press portions 632 can be laterally moved relative to the fixing portions 62 by a short stroke (movement amount), so that the tube press portions 632 can be moved substantially in parallel. Thus, even when only one tube is provided, the tube press portions 632 squeeze the tube in parallel to the tube receivers. Consequently, the tube press portions 632 equally squeeze the tube to reliably close the flow path of the tube, thereby suppressing deterioration of the tube. In other words, since the fingers 60 of the invention are integrated with the finger plates 61, the fingers 60 can equally squeeze a tube even when only one tube is provided.

The tube is not limited to that in the exemplary embodiment. For example, two separate tubes may be provided for supplying and delivering liquid, and may be jointed together by the connector 41 to connect the end tube 43B for discharging the liquid.

Further, two completely separate tubes for supplying, delivering and discharging liquid may be used.

Although the tubes 42A and 42B are respectively provided between the tube press portions 632 and the tube receivers 31 and 32 in the exemplary embodiment, two or more tubes may be respectively provided. In other words, a plurality of tubes may be provided between the tube press portions 632 and the tube receivers 31 and 32 in a direction where the press portions 632 project, and squeezed by the tube press portions 632 and the tube receivers 31 and 32 so that the flow paths of the tubes are opened and closed. Thus, a discharge amount can be increased in accordance with a number of tubes.

Also, the motor driven by the external controller may be a servo motor or a stepper motor. When the servo motor is used, a connector for connecting a power line and a signal line that control the servo motor to the controller is attached to the cover 3. When the stepper motor is used, a connector for connecting a power line that controls the stepper motor to the controller is attached to the cover 3.

The best arrangement and method for carrying out the invention is described above, but the invention is not limited to thereto. In other words, while the invention is particularly explained and illustrated mainly in relation to a specific embodiment, a person skilled in the art could make various modifications in terms of shape, material, quantity or other particulars to the above-described embodiment without departing from the spirit and scope of the invention.

Accordingly, any descriptions of shape, material or the like disclosed above are given as examples to enable easy understanding of the invention, and do not limit the invention, so that descriptions using names of components, with any such limitations of shape, material or the like removed in part or whole, are included in the invention.

What is claimed is:

1. A tube pump comprising:

two tubes;

first and second tube engagements;

first and second tube receivers;

three or more fingers; and a drive mechanism that drives the fingers, wherein the first and second tube engagements are spaced away from each other by a predetermined gap and the two tubes are detachably engaged in parallel between the tube engagements, the first and second tube receivers are provided along the two tubes so that the two tubes are interposed between the first and second tube receivers, the fingers each include a tube press portion interposed between the two tubes, the fingers being provided along the two tubes, the drive mechanism includes a motor and a drive shaft rotated by the motor, the fingers each include a finger plate that is thin plate-shaped and a cam rotated together with the drive shaft, the finger plate is an integrated component comprising a fixing portion fixed to a casing of the tube pump, a moving portion connected to the fixing portion via a pair of first hinges, and a drive shaft portion connected to the moving portion via a pair of second hinges, the cam is an eccentric cam in which the drive shaft is fixed to a position eccentric to a center of the cam, and is rotatably supported in a hole provided on the drive shaft portion, the moving portion is provided with the tube press portion, the first hinges and the second hinges extend in mutually orthogonal directions, the pair of the first hinges are provided such that the tube press portion of the moving portion is reciprocated between the two tubes relative to the fixing portion, the pair of the second hinges are provided such that the drive shaft portion is movable relative to the moving portion in a direction orthogonal to a direction where the moving portion is moved by the pair of the first hinges on a plane orthogonal to the drive shaft, and the drive mechanism drives each of the fingers to reciprocate between: a position where one of the two tubes is squeezed between the tube press portion and the first tube receiver; and a position where the other of the two tubes is squeezed between the tube press portion and the second tube receiver, and also drives each of the fingers so that the tubes are squeezed in sequence by the tube press portion from a position where the tubes are engaged with the first tube engagement toward a position where the tubes are engaged with the second tube engagement.

2. The tube pump according to claim 1, wherein both ends of the tubes are provided by one end tube element and an intermediate portion of the tubes is provided by two intermediate tube elements branched from the one end tube element, and the two intermediate tube elements of the intermediate portion has a length to be strained in parallel to each other between the tube engagements when branched portions of the tube are engaged with the tube engagements of the tube pump.

3. The tube pump according to claim 2, wherein the one end tube element of the both ends and the two intermediate tube elements of the intermediate portion are separately provided, and the one end tube element of the both ends and the two intermediate tube elements of the intermediate portion are connected via Y-shaped connectors.

* * * * *